US008336460B2

(12) United States Patent
Tiainen et al.

(10) Patent No.: US 8,336,460 B2
(45) Date of Patent: Dec. 25, 2012

(54) SUPPORT MEMBER FOR SUPPORTING SHELL INTO WEAPON BARREL, AND METHOD

(75) Inventors: Jukka Tiainen, Sastamala (FI); Jari Grönlund, Sastamala (FI); Kalevi Yli-Paavola, Kangasala (FI)

(73) Assignee: Patria Land Systems Oy, Helsinki (FI)

( * ) Notice: Subject to any disclaimer, the term of this patent is extended or adjusted under 35 U.S.C. 154(b) by 229 days.

(21) Appl. No.: 12/747,402

(22) PCT Filed: Jan. 30, 2009

(86) PCT No.: PCT/FI2009/050080

§ 371 (c)(1),
(2), (4) Date: Jul. 2, 2010

(87) PCT Pub. No.: WO2009/095542

PCT Pub. Date: Aug. 6, 2009

(65) Prior Publication Data

US 2010/0263567 A1 Oct. 21, 2010

(30) Foreign Application Priority Data

Jan. 31, 2008 (FI) ..... 20085077

(51) Int. Cl.
*F42B 10/00* (2006.01)

(52) U.S. Cl. ..... 102/439; 102/293; 102/372; 102/469; 102/483

(58) Field of Classification Search ..... 102/504, 102/439, 293, 372, 469, 483, 520, 523
See application file for complete search history.

(56) References Cited

U.S. PATENT DOCUMENTS

| | | | | |
|---|---|---|---|---|
| 2,383,053 | A | 8/1945 | Fanger et al. | |
| 4,444,115 | A * | 4/1984 | Romer et al. | 102/431 |
| 4,505,179 | A * | 3/1985 | Nelson et al. | 89/16 |
| 4,542,696 | A * | 9/1985 | Bisping et al. | 102/430 |
| 4,763,577 | A * | 8/1988 | Romer et al. | 102/431 |
| 4,823,699 | A * | 4/1989 | Farinacci | 102/443 |
| 5,503,080 | A | 4/1996 | Goward et al. | |
| 6,257,148 | B1 * | 7/2001 | Toivonen et al. | 102/439 |
| 6,272,997 | B1 | 8/2001 | James et al. | |
| 8,042,470 | B2 * | 10/2011 | Dietrich et al. | 102/215 |
| 2010/0269722 | A1 * | 10/2010 | Niemi et al. | 102/293 |
| 2010/0288150 | A1 * | 11/2010 | Kautto et al. | 102/293 |

FOREIGN PATENT DOCUMENTS

| | | |
|---|---|---|
| GB | 924 062 A | 4/1963 |
| SE | 80926 C | 7/1934 |

* cited by examiner

*Primary Examiner* — Samir Abdosh
(74) *Attorney, Agent, or Firm* — Birch, Stewart, Kolasch & Birch, LLP

(57) ABSTRACT

A support member and method for supporting a shell into the barrel of a breech-loading weapon. The support member (6) comprises a support element (8) with an rim flange (7), end (16), and edge casing (12), and means for fastening the support element (8) to at least one fin (5) belonging to the tail end (4) of the shell (1). The means for fastening the support element (8) to the tail end (4) of the shell (1) comprise a retainer part (9) arranged to the edge casing (12) and arranged to circle the inner surface (10) of the edge casing essentially level with the plane of the rim flange (7).

19 Claims, 2 Drawing Sheets

SUPPORT MEMBER FOR SUPPORTING SHELL INTO WEAPON BARREL, AND METHOD

FIELD OF THE INVENTION

The invention relates to a support member for supporting a shell into the barrel of a breech-loading weapon, the support member comprising a support element with an rim flange, end, and edge casing, and the support member further comprising means for fastening the support element to at least one fin belonging to the tail end of the shell.

The invention further relates to a method for fastening a support member to a shell, the method comprising arranging to the tail end of the shell a support member that comprises a support element furnished with an rim flange, and fastening the support member to at least one fin in the tail end of the shell.

BACKGROUND OF THE INVENTION

A mortar may be arranged on a movable platform, such as on an armoured vehicle, whereby the mortar may be easily moved from one location to another, and on the other hand, it may be quickly moved to safety from an emplacement. If the mortar is to be fired horizontally or downward, a problem arises from the fact that the shell does not stay in place in the mortar barrel, but may slip forward in the barrel so that it can no longer be triggered. U.S. Pat. No. 5,503,080 discloses a support member that is fastenable by friction to the fins in the tail end of the shell. The solution taught by the patent has the problem that its application requires very exact measurements of both the tail end of the shell and the support member itself to be able to function at least fairly reliably.

BRIEF DESCRIPTION OF THE INVENTION

It is an object of the present invention to provide a novel and improved support member for supporting a shell into the barrel of a breech-loading weapon, and a method for fastening such a support member.

The support member of the invention is characterised in that the means for fastening the support member to the tail end of the shell comprise a retainer part arranged to the edge casing and arranged to circle the inner surface of the edge casing essentially level with the plane of the rim flange.

The method of the invention is characterised by fastening a fin of the shell to the support member by means of the retainer part arranged to the edge casing, the retainer part being arranged to circle the inner surface of the edge casing essentially level with the plane of the rim flange.

The essential idea of the invention is that the shell is fastened to the support member by form-locking fastening means that lock the fin of the shell and the edge casing of the support member together.

In the invention the fastening of the support member to the tail end of the shell is based on form-locking, whereby the fastening is more secure than that based on friction. In addition, possible dimensional variances caused by the manufacturing of the shell do not affect as critically the size of the fastening forces and the fastening of the support member as in a friction-locked solution. In the solution of the invention, the management of the fastening forces is relatively easy. Further, the invention provides the advantage that the support piece is easy and quick to fasten to the tail end of the shell even in difficult conditions.

The essential idea of an embodiment of the invention is that the retainer part comprises a support edge that is fastened by means of a bending element to the edge casing, and the bending of the flexible element allows the fired shell to detach from the support member.

The essential idea of a second embodiment of the invention is that the retainer part comprises threading grooves in the longitudinal direction of the shell and arranged radially, through which the fins of the shell may be pushed to the rear side of the retainer part.

The essential idea of a third embodiment of the invention is that, at the end of the edge casing, a receiving ring is formed that comprises a surface converging toward the end of the support element. The converging surface of the receiving ring facilitates the threading of the fins inside the edge casing.

BRIEF DESCRIPTION OF FIGURES

The invention will be described in more detail in the attached drawings, in which.

In the figures, the invention is shown simplified for the sake of clarity. Similar parts are marked with the same reference numbers in the figures.

DETAILED DESCRIPTION OF THE INVENTION

Figure 1:
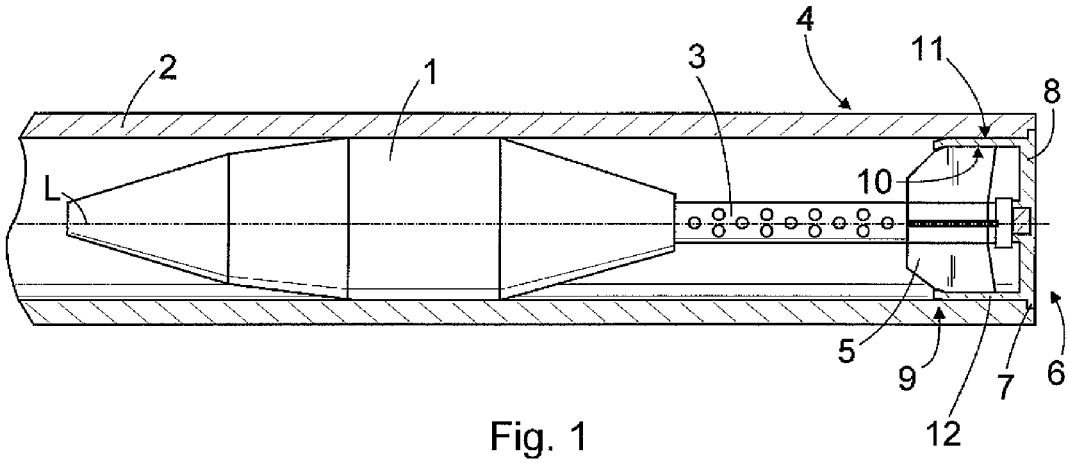
FIG. 1 is a schematic representation of a shell supported by means of the support member of the invention into a barrel of a weapon with the support member shown in cross-section.

FIG. 1 is a schematic representation of a shell supported by means of a support member of an embodiment according to the invention into the barrel of a weapon.

The shell 1 is arranged into the barrel 2 of a breech-loading weapon. The weapon may be a mortar in which the inner surface of the barrel 2 is essentially smooth. The rear of the shell 1 has a tail tube 3 and a tail end 4. The tail end 4 comprises one or typically several fins 5 that are used to affect the flight path of the shell 1. The construction of the shell 1 may in detail differ from that shown in the figure. For the sake of clarity, the breech or other details of the weapon are not shown.

A support member 6 of the invention is fastened to the tail end 4 so that the shell 1 may be kept in place in the barrel 2 until it is fired. An edge casing 12 on a support element 8 belonging to the support member 6 is dimensioned such that at least part of the tail end 4 of the shell 1 may be accommodated inside it. A rim flange 7 on the support member 6 prevents the shell 1 from moving forward in the barrel 2 when the barrel 2 is directed in the horizontal direction or even downward. The support member 6 is dimensioned so that it endures the loads caused by the mass of the shell 1 and any forces caused by the vibration and accelerations generated during the transportation and handling of the shell.

The support member 6 has means for fastening the support element 8 to at least one fin 5 belonging to the tail end 4 of the shell 1. The means comprise a retainer part 9 that is arranged to the edge casing 12 and circles the inner surface 10 of the edge casing on essentially perpendicular plane to the longitudinal direction L of the shell, that is, level with the plane of the rim flange 7. In the embodiment of FIG. 1, the retainer part 9 is formed at the end of the edge casing 12. The retainer part 9 substantially reduces the inner diameter of the edge casing 12 that is a diameter measure in the direction of the plane of the rim flange 7.

The outer diameter of the edge casing 12 is at the retainer part 9 correspondingly smaller than at other parts of the edge casing 12, in other words, the retainer part 9 does not per se alter the wall thickness of the edge casing 12. The retainer part 9 bends outward forced by the fins 5 of the shell, when the shell is fired. In spite of this, the support member 6 is in some cases reusable.

Figure 2:
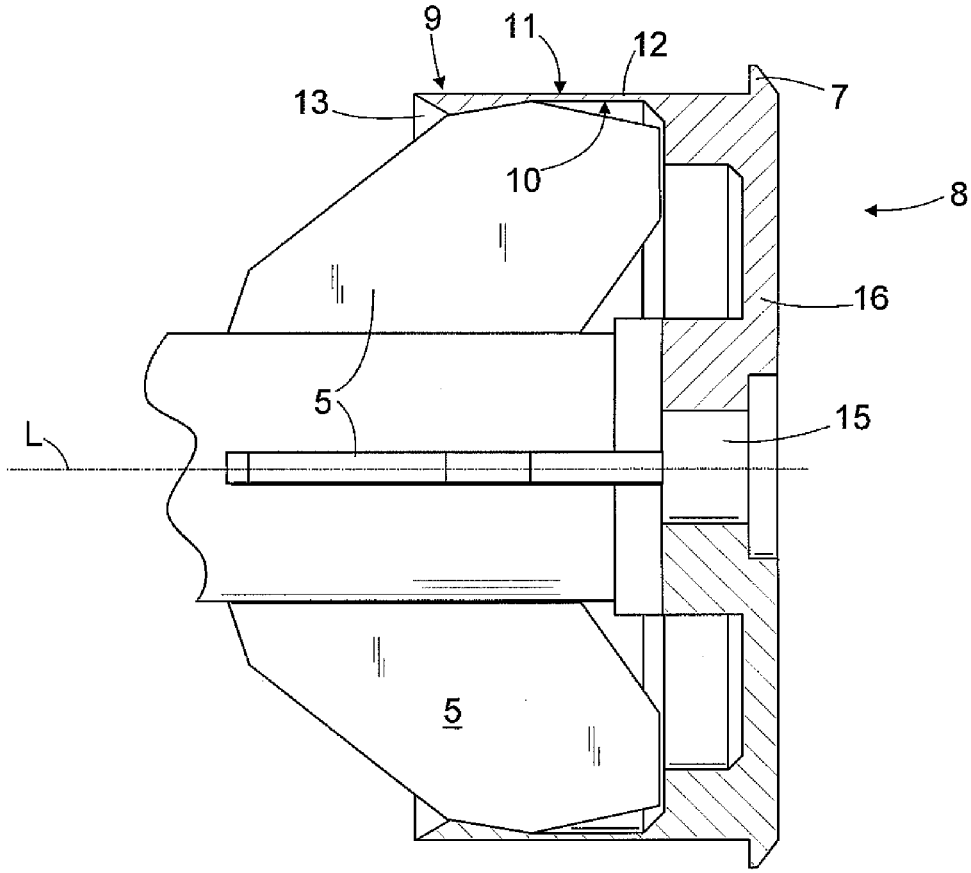
FIG. 2 is a schematic representation of a second support member of the invention fastened to a shell and shown from the side and in partial cross-section.

FIG. 2 is a schematic representation of a second support member of the invention fastened to a shell and shown from the side and in partial cross-section. The support element 8 belonging to the support member comprises an end 16, edge casing 12 and rim flange 7. Further, a space 15 for a trigger mechanism that may comprise an intermediate firing pin is arranged in the support element 8. The firing pin of the weapon may be arranged to hit a detonator cap of the shell 1 through the intermediate firing pin and to trigger the actual charge of the shell 1. Other trigger mechanisms known in the field may naturally also be used. It should further be noted that the support element 8 does not necessarily have any parts belonging to the trigger mechanism—instead, the end 16, for instance, may simply comprise an opening through which the firing pin of the weapon, or the like, triggers the charge that provides the shell with kinetic energy.

The embodiment of FIG. 2 differs from that of FIG. 1 firstly in that the outer diameter of the edge casing 12 is at the retainer part 9 at least essentially equal in size with other points of the edge casing 12. The outer diameter of the edge casing 12 is constant over its entire length. The retainer part 9 is formed of a thickening of the wall of the edge casing 12 that essentially reduces the inner diameter of the edge casing 12.

Another significant difference to the embodiment of FIG. 1 is that at the end of the edge casing 12, a receiving ring 13 is formed to comprise a surface converging toward the end 16 of the support element 8. This guides and facilitates the insertion of the fins 5 of the shell into the support member.

A third significant difference is that the retainer part 9 is positioned at a distance from the end of the edge casing 12.

The retainer part 9 may be formed of a continuous circular structure circling the inner surface 10 of the edge casing 12, or it may be formed of several separate parts that are arranged on an imaginary circle formed of the intersection of a plane parallel with the plane of the rim flange 7 and the inner surface 10.

Another solution for fastening the support member 6 to the shell comprises a retainer bushing that is fastened beneath a base of the propelling charge of the shell 1. The bushing part of the retainer bushing extends past the base of the propelling charge and settles in the support element 8 on the outer surface of a hub structure surrounding the space 15. The bushing part is made of a permanently bendable material.

At least one groove circling the outer surface of the hub structure is formed using a lathe, for instance. Said at least one groove is arranged on a spatial plane that is parallel to the plane of the end 16. Most preferably one groove is formed that circles the hub structure.

The bushing part of the retainer bushing is pressed with a suitable tool so that part of the bushing part bends into a groove, whereby the bushing part fastens to the hub structure. The bushing part may bend evenly and continuously into a groove, or by cockling like a crown cap, or in some other manner. The pressing may already be done in the filling plant, or later in the field.

Between the part of the bushing part bent into a groove and the part of the retainer bushing fastened beneath the base of the propelling charge of the shell 1, there is a weakened area that preferably circles the entire retainer bushing. The weakened area may be formed of a thinned material, perforated material or the like. When the shell 1 is fired, the retainer bushing breaks at the weakened area and, consequently, the part above the weakened area flies off with the shell, whereas the part beneath the weakened area remains fastened to the support member 6. The latter part is difficult to unfasten from the support member 6, which complicates the re-use of the support member 6. The re-use of the support member 6 is typically forbidden.

Figure 3A:
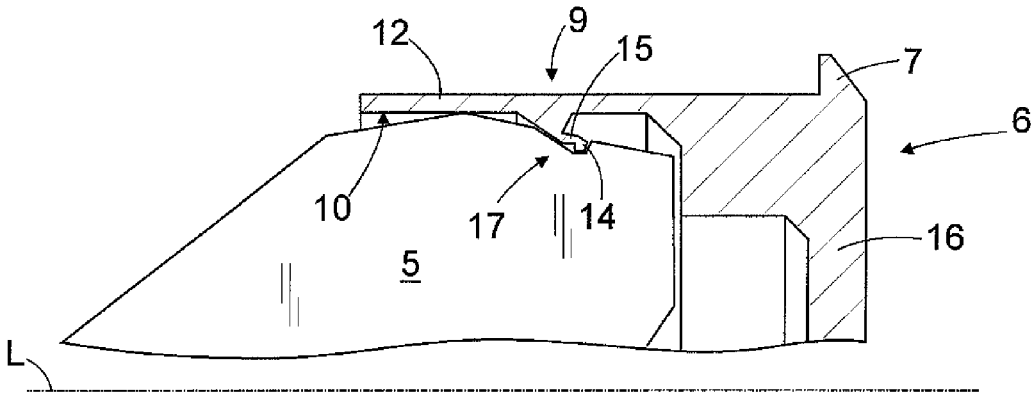
FIG. 3*a* is a schematic representation of a third support member of the invention fastened to a shell and shown from the side and in partial cross-section.
Figure 3B:
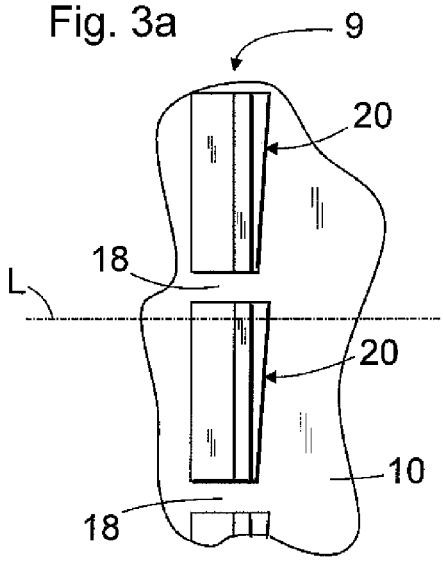
FIG. 3*b* is a detail of the support member of FIG. 3*a* as seen from the inside.

FIG. 3*a* is a schematic representation of a third support member of the invention fastened to a shell and shown from the side and in partial cross-section, and FIG. 3*b* is a detail of the same support member shown from the inside. It should be noted in this context that the support member 6 is shown only partially in FIGS. 3*a*, 3*b*, and 4.

The retainer part 9 comprises a support edge 14 that is integrated and fastened through the bending element 15 to the edge casing 12.

The fin 5 comprises a recess 17 into which the support edge 14 settles when the shell is inserted into the support member 6. The retainer part 9 with its support edge 14 and bending element 15 may be made of the same material as the support member 6 using a lathe, for instance. The design and dimensioning of the retainer part 9 defines a suitable fastening force for the retainer part 9.

When the shell is fired, the bending element 15 bends under the force directed to it by the fin 5 and allows the detachment of the shell from the support member 6. During firing no parts are detached from the support member 6 and it is removed as a whole from the weapon by opening the breech of the weapon.

As shown in FIG. 3*b*, the retainer part 9 comprises threading grooves 18 in the longitudinal direction L of the shell and arranged radially, and through the grooves the fins 5 of the shell may be pushed past the retainer part 9 against the bottom 16 or some other corresponding surface. The number, dimensions and position of the threading grooves 18 are selected so that all fins 5 of the shell may be arranged simultaneously into a threading groove 18. Usually one fin 5 goes into one threading groove 18, but the threading groove 18 may also be made wide enough to accommodate two or even more fins 5 at the same time. On the other hand, the number of threading grooves 18 may also be greater than the number of the fins 5 of a certain type of shell.

On the support edge 14 of the retainer part 9, surfaces 20 are formed that ascend in the manner of a low-gradient screw thread in the longitudinal direction L of the shell and in the same direction between two threading grooves 18. The ascending surface 20 may be arranged between every two threading grooves 18 or between just a few adjacent threading grooves 18.

The shell is fastened to the support member 6 by pushing the fins 5 far enough into the threading grooves 18, after which the shell is turned around its longitudinal direction L in relation to the support member 6 to the direction where the ascending surface 20 wedges against the fin 5. The ascending surface 20 may be made of a material softer than that of the fin 5, whereby the fin 5 forms into the ascending surface 20 a space to lock into.

Figure 4:
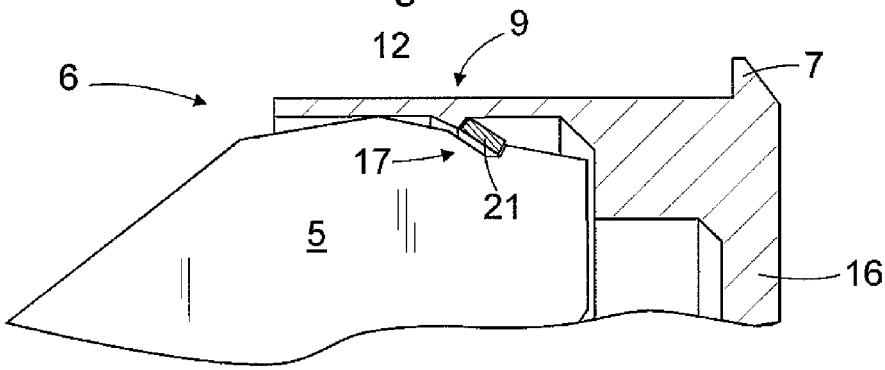
FIG. 4 is a schematic representation of a fourth support member of the invention fastened to a shell and shown from the side and in partial cross-section.

FIG. 4 is a schematic representation of a fourth support member of the invention fastened to a shell and shown from the side and in partial cross-section. In this embodiment, the retainer part 9 is not necessarily in immediate contact with the fin 5 of the shell arranged into the support member 6. Instead, between the retainer part 9 and fin 5, there is arranged a conical retainer ring 21 with a first side 22 leaning against the back surface 19 of the retainer part 9, while a second side 23 is arranged against the fin 5 of the shell. The fin 5 comprises a recess 17 into which the second side 23 of the retainer ring 21 is positioned. The fin 5 of the shell does not necessarily need to have a recess 17, and the mating surface of the second side 23 of the retainer ring 21 may be a suitable bracket in the fin.

The retainer ring 21 is a separate part from the edge casing 12, and in one embodiment, it is made of a material that essentially burns away in the heat caused by the combustion gases of firing the shell. The shell then detaches from the support member 6 and any unburned retainer ring 21 material will fly out of the barrel after the shell. No retainer ring 21 material will preferably remain in the shell. One useful material is magnesium or magnesium alloys, but other metallic as well as non-metallic burning materials may be used to make the retainer ring 21. The essential thing is that the material burns quickly in the heat generated by the firing and that retainer rings 21 of uniform quality may be made of the material, whereby no random variations will occur in their burning process to affect the flight path of the shell.

Naturally, it is also possible to make the separate retainer ring 21 of a material that does not burn away in the heat caused by the combustion gases of firing. The retainer ring 21 is then suitably flexible or shearable so that the shell will detach from the support member 6 without damaging the fins 5.

The retainer ring 21 may comprise threading grooves 18 shown in FIG. 3*b* to facilitate the insertion of the fins 5 to the rear side of the retainer ring 21, and ascending back surfaces 20 that wedge the fins 5 between the retainer ring 21 and end 16 or some other mating surface or shoulder. Members or surfaces preventing or reducing the turning of the retainer ring 21 may be arranged between the retainer ring 21 and back surface 19.

The cross-section of the retainer ring 21 of FIG. 4 is rectangular, but may naturally also be of another shape. Grooves or ridges adjusting the flexibility or rigidity of the retainer ring 21 may be arranged thereto for instance in the direction of its circumference or radius.

In some cases, the features presented in this application may be used as such, regardless of other features. On the other hand, the features presented in this application may, if necessary, be combined to form various combinations.

The drawings and the related description are only intended to illustrate the idea of the invention. The invention may vary in detail within the scope of the claims.

The invention claimed is:

1. A support member for supporting a shell into the barrel of a breech-loading weapon, the support member comprising a support element with a rim flange, end, and edge casing, and the support member further comprising means for fastening the support element to at least one fin belonging to the tail end of the shell, wherein the means for fastening the support element to the tail end of the shell comprises a retainer part formed onto the edge casing and arranged to circle the inner surface of the edge casing essentially level with the plane of the rim flange, and arranged to reduce the inner diameter of the edge casing by converging toward a longitudinal direction of the shell away from the end of the support element.

2. The support member as claimed in claim 1, wherein the retainer part is arranged at the end of the edge casing.

3. The support member as claimed in claim 1, wherein the retainer part is arranged at a distance from the end of the edge casing.

4. The support member as claimed in claim 1, wherein the thickness of the wall of the edge casing is constant.

5. The support member as claimed in claim 1, wherein the outer diameter of the edge casing is constant along its entire length.

6. The support member as claimed in claim 1, wherein the retainer part comprises a support edge that is fastened by means of a bending element to the edge casing, and the bending of the bending element allows the fired shell to detach from the support member.

7. The support member as claimed in claim 1, wherein the retainer part continuously circles the entire inner surface of the edge casing.

8. The support member as claimed in claim 1, wherein the retainer part is formed of several separate parts.

9. The support member as claimed in claim 1, wherein the retainer part comprises threading grooves in the longitudinal direction of the shell and arranged radially, through the grooves the fins of the shell are inserted to the rear side of the retainer part.

10. The support member as claimed in claim 9, wherein the retainer part comprises a back surface ascending in the longitudinal direction of the shell.

11. The support member as claimed in claim 1, wherein the retainer part is integrated to the edge casing.

12. The support member as claimed in claim 1, further comprising a separate retainer ring arrangeable between the retainer part and the fin of the shell so that a first side of the retainer ring leans against the back surface of the retainer part while a second side is arranged against the fin of the shell so that form-locking is formed between the fin and support member.

13. The support member as claimed in claim 12, wherein the retainer ring is made of a material that burns away in the heat generated by the combustion gases of firing the shell.

14. The support member as claimed in claim 1, wherein at the end of the edge casing, a receiving ring is formed that comprises a surface that converges toward the end of the support element.

15. A method for fastening a support member to a shell, the method comprising arranging to the tail end of the shell a support member that comprises a support element furnished with an rim flange, and fastening the support member to at least one fin in the tail end of the shell, wherein fastening the fin of the shell to the support member by means of a retainer part formed onto the edge casing, the retainer part being arranged to circle the inner surface of the edge casing essentially level with the plane of the rim flange and to reduce the inner diameter of the edge casing by converging toward a longitudinal direction of the shell away from the end of the support element.

16. The support member as claimed in claim 2, wherein the thickness of the wall of the edge casing is constant.

17. The support member as claimed in claim 3, wherein the thickness of the wall of the edge casing is constant.

18. The support member as claimed in claim 2, wherein the outer diameter of the edge casing is constant along its entire length.

19. The support member as claimed in claim 3, wherein the outer diameter of the edge casing is constant along its entire length.

* * * * *